US006332676B1

(12) United States Patent
Santhanam

(10) Patent No.: US 6,332,676 B1
(45) Date of Patent: Dec. 25, 2001

(54) VENT FOR AN INK-JET PRINT CARTRIDGE

(75) Inventor: Ram Santhanam, San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/477,645

(22) Filed: Jan. 5, 2000

(51) Int. Cl.[7] ..... B41J 2/175
(52) U.S. Cl. ..... 347/86
(58) Field of Search ..... 347/85, 86, 87

(56) References Cited

U.S. PATENT DOCUMENTS 5,182,581 * 1/1993 Kashimura et al. ..... 347/87
5,409,134 * 4/1995 Cowger et al. ..... 347/87
5,751,319 * 5/1998 Robertson et al. ..... 347/85
5,907,341 * 5/1999 Miyazawa ..... 347/86
5,917,525 * 6/1999 Butty ..... 347/86
6,000,789 * 12/1999 Takagi et al. ..... 347/86
6,158,852 * 12/2000 Sato et al. ..... 347/85

* cited by examiner

*Primary Examiner*—Anh T. N. Vo

(57) ABSTRACT

An ink-jet print cartridge includes a body with a lid. The body defines a vent structure communicating between ambient and an ink reservoir internally of the body. One embodiment of the vent structure includes a straight cylindrical bore opening through the lid of the print cartridge body between ambient and the ink reservoir. This vent structure includes a tapered annular surface surrounding the opening of the straight cylindrical bore on a surface of the lid, so as to direct ink away from the opening of the bore. An annular ink well surrounds the tapered annular surface so as to catch and hold ink flowing along this surface away from the opening of the straight cylindrical bore.

3 Claims, 3 Drawing Sheets

VENT FOR AN INK-JET PRINT CARTRIDGE

RELATED APPLICATIONS

This application is related to the following copending utility patent applications, each filed concurrently on Jan. 5, 2000:

Ser. No.: 09/477,644, by Junji Yamamoto et al., entitled "Horizontally Loadable Carriage For An Ink-Jet Printer";

Ser. No.: 09/477,646 by Ram Santhanam et al., entitled "Ink-Jet Print Cartridge Having A Low Profile";

Ser. No.: 09/477,644 by Junji Yamamoto et al., entitled "Horizontally Loadable Carriage For An Ink-Jet Printer";

Ser. No.: 09/477,649 by Junji Yamamoto et al., entitled "Method And Apparatus For Horizontally Loading And Unloading An Ink-Jet Print Cartridge From A Carriage";

Ser. No.: 09/478,148 by Richard A. Becker et al., entitled "Techniques For Providing Ink-Jet Cartridges With A Universal Body Structure";

Ser. No.: 09/477,843 by Ram Santhanam et al., entitled "Techniques For Adapting A Small Form Factor Ink-Jet Cartridge For Use In A Carriage Sized For A Large Form Factor Cartridge";

Ser. No.: 09/478,190 by James M. Osmus, entitled "Printer With A Two Roller, Two Motor Paper Delivery System";

Ser. No.: 09/477,860 by Keng Leong Ng, entitled "Low Height Inkjet Service Station";

Ser. No.: 09/477,648 by Matt Shepherd et al., entitled "New Method of Propelling An Inkjet Printer Carriage";

Ser. No.: 29/116,564 by Ram Santhanam et al., entitled "Ink Jet Print Cartridge"; and Ser. No.: 09/477,940 by Ram Santhanam et al., entitled "Multiple Bit Matrix Configuration For Key-Latched Printheads", all of which are incorporated by reference.

FIELD OF INVENTION

The present invention generally relates to ink-jet print cartridges and, more particularly, to their construction.

BACKGROUND OF THE INVENTION

The general construction and operation of an ink-jet print cartridge using reticulated polyurethane foam is disclosed in U.S. Pat. No. 4,771,295 entitled "Thermal Ink Jet Pen Body Construction Having Improved Ink Storage and Feed Capacity" by Baker et al. issued Sep. 13, 1988.

The ink reservoir of such a print cartridge is vented to the atmosphere so that when ink is being expelled during operation of the cartridge, a vacuum is not created in the reservoir and the pressure of the ink behind the print head can be properly maintained by the foam at about −2" of water.

The size of the vent must be sufficiently large so that at the maximum printing speed of the cartridge such a vacuum is not produced, affecting the operation of the cartridge. On the other hand, the size of the vent must not be so large that the water in the ink evaporates too quickly, causing the cartridge to dry out and become useless before the end of its intended life.

There are other challenges as well in the design of vents for ink-jet print cartridges. The size of the vent and its construction must be such that when the print cartridge is held with the vent downward, the ink does not run out into the printer or onto the user. Further, the vent should be designed so that it is not easily clogged by debris and dried ink and is also not blocked by liquid ink drawn into the vent by the capillary effect.

Lastly, prior vent designs have been unable to withstand harsher environments than the normal office. A vent is needed for a print cartridge that will be used in a printer designed to be stacked in a home entertainment center. Such an environment is hotter, more dusty, and drier than offices and commercial facilities.

Thus, it should be apparent from the foregoing that the design and construction ink-jet print cartridges offer many challenges and trade offs. There is still a need for an approach that sufficiently vents at maximum cartridge printing speed, minimizes water loss through evaporation, avoids leakage, and withstands harsh environments.

SUMMARY OF THE INVENTION

Briefly and in general terms, an apparatus according to the invention includes a vent for an ink-jet print cartridge having a body and a lid. Communicating through the lid is a straight bore having an opening and a tapered annular surface surrounding the opening of the bore.

In an alternative embodiment, the invention includes a straight bore communicating through the lid and an annular ring located on the lid surrounding the opening of the bore.

In a second alternative embodiment, the invention includes a straight bore communicating through the lid and having an opening that flares outwardly into the body of the print cartridge.

Other aspects and advantages of the invention will become apparent from the following detailed description, taken in conjunction with the accompanying drawings, illustrating by way of example the principles of the invention.

DESCRIPTION OF THE PREFERRED EMBODIMENTS

Figure 1:
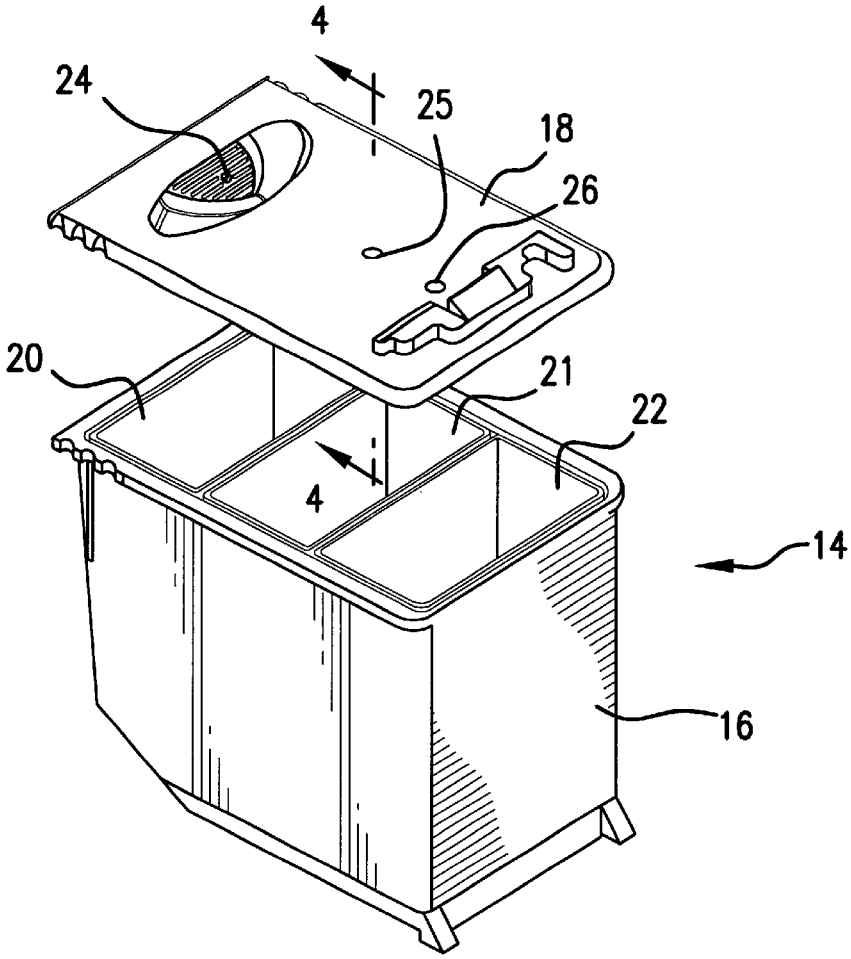
FIG. 1 is a perspective view, partially exploded, of a ink-jet print cartridge having a vent embodying the principles of the invention.

As shown in the drawings for the purposes of illustration, the invention is embodied in a vent for an ink-jet print cartridge.

The apparatus offers a simple, reliable solution that sufficiently vents at maximum cartridge printing speed, minimizes water loss, avoids leakage and clogging, and withstands harsh environments.

Referring to FIG. 1, reference numeral 14 generally indicates an ink-jet print cartridge having a body 16 and a lid 18. Although the print cartridge is illustrated with the lid removed, the cartridge is filled with foam, not shown, and ink, likewise not shown, during manufacturing and the lid is ultrasonically welded shut. The lid 18 is not intended to be removed from the body 16 by the user. The body 16 contains three ink chambers 20, 21, 22 that are isolated from each other for holding inks of different hues. The three chambers are each connected to a separate series of nozzles, not shown, that are independently energized to expel droplets of ink in the conventional manner.

Referring to FIG. 1, each chamber 20, 21, 22 within the body 16 of the print cartridge 14 is independently vented to the atmosphere by three vents 24, 25, 26 that are described in detail below. As ink is expelled from the print cartridge, air at atmospheric pressure passes through the vents and refills the chambers.

Figure 2:
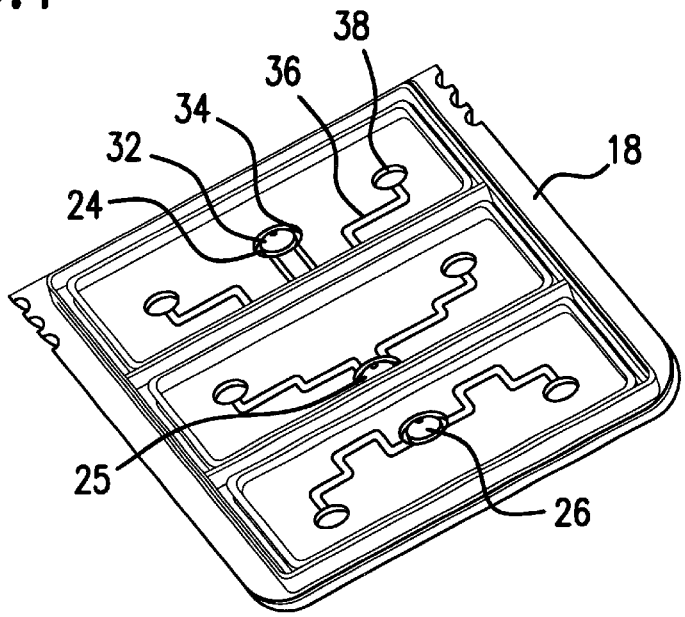
FIG. 2 is a perspective of the bottom side of the lid of FIG. 1.
Figure 3:
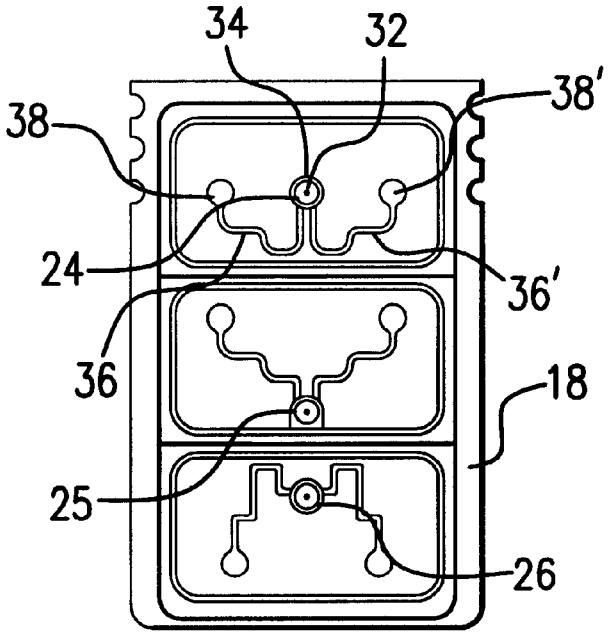
FIG. 3 is a bottom elevational view of the lid of FIG. 1.
Figure 4:
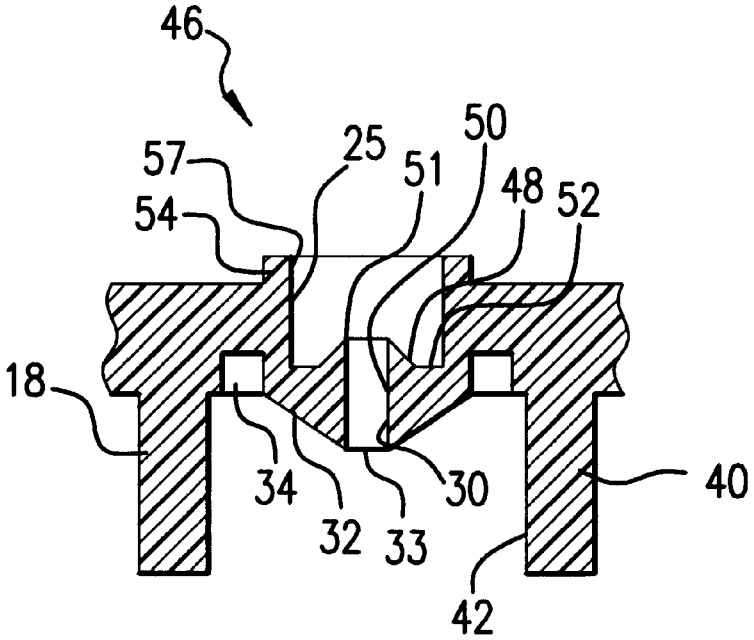
FIG. 4 is a side elevational view, partially cut away, taken along line 4—4 of FIG. 1.

Referring to FIGS. 2, 3, and 4, each of the vents 24, 25, and 26 contains an unobstructed bore 30 that communicates through the lid 18. The bore has a tapered surface 32 in the shape of a frustrum of a cone, and the edge 33 of the opening to the bore 30 is sharply defined. The tapered surface 32 leads to an annular ink well 34 in the shape of an annular trough that surrounds the bore and is co-axial with it. Referring to FIGS. 2 and 3, the ink well 34 is connected by two tortuous conduits 36 to two ink reservoirs 38 on the chamber-side of the lid 18. In the embodiment that has actually been constructed the bore was fifty thousandths of an inch (0.050") long and twenty thousandths of an inch (0.020") in diameter.

Each chamber 20, 21, 22, FIG. 1, is filled with foam, not shown, and the ink primarily resides in the foam. If the print cartridge is inverted and the vent is pointed downward, any free ink, that is to say not in the foam, will fall on to the chamber-side of the lid 18. The sharp edge 33 around the opening of the bore breaks up any drops of free ink that approach the bore by over coming their surface tension. The sharp edge and the tapered surface 32 also act to direct any free ink away from the bore 30. Any free ink that flows down the tapered surface 32 and into the ink well 34 is thereafter directed away from the vent by the tortuous conduits 36 and is retained in the ink spill reservoirs 38. The sharp edge 33, the tapered surface 32, the tortuous conduits 36 and the ink spill reservoirs 38 all operate together to keep the ink from blocking the bore 30 and to direct any free ink within the chambers 20, 21,22, FIG. 1, as far away from the bore as possible.

Referring to FIG. 4, reference numeral 40 indicates the wall of a counter bore 42. This counter bore compresses the foam thereby keeping the foam away from the sharp edge 33 and the bore 30. The counter bore also acts as a further barrier to any free ink coming into contact with the bore 30 and blocking it.

As much as one would like to avoid it, there is always the possibility of ink spilling out of the bore 30, FIG. 4, through volumetric changes induced by thermal cycling or pressure changes. To prevent the ink from flowing into the printer or onto the user, a second ink fountain 46 is molded into the top of the lid 18, FIG. 4. The bore has a tapered surface 48 in the shape of a frustrum of a cone, and the edge 50 of the opening to the bore 30 is sharply defined. The tapered surface 48 leads to an annular ink well 52 in the shape of an annular trough that surrounds the bore and is co-axial with it. The ink well is formed by the wall 54 of circular counter bore 57.

Referring to FIG. 4, if ink flows upward and out the opening 50 of the bore 30, the sharp edge 51 of the opening 50 will break up the drops and the ink will flow down the tapered surface 48 into the ink well 52. The ink is thereby trapped by the ink fountain 46. In time the liquid ink will dry in the ink well and the threat of clogging is eliminated. This construction also eliminates the need to draw the ink back into the print cartridge through the bore 30 or the need to relocate the ink to a less troublesome location.

Figure 5:
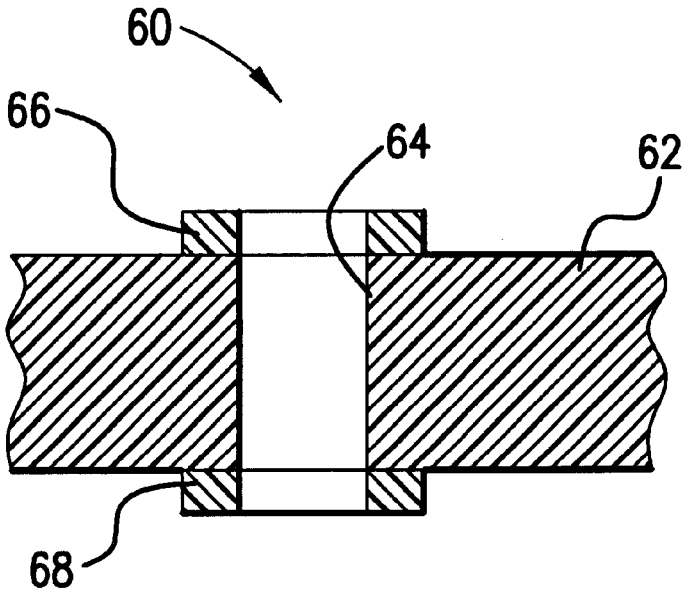
FIG. 5 is a side elevational view, partially cut away, of an alternative embodiment of the vent of the present invention.

Referring to FIG. 5, reference numeral 60 generally indicates a vent according to an alternative embodiment of the invention. The vent 60 is located in a lid 62 and permits air at atmospheric pressure to flow into one of the chambers 20, 21, 22, FIG. 1. The vent includes a straight bore 64 that communicates through the lid 62. Located on the top surface of the lid is an annular ring 66 that prevents dust and debris from clogging the vent. Located on the chamber-side of the lid is a second annular ring 68 that prevents ink from being drawn up into the vent by the capillary effect. In one embodiment of the vent 60 that was actually constructed, the bore was the bore is fifty thousandths of an inch (0.050") long and twenty thousandths of an inch (0.020") in diameter.

Figure 6:
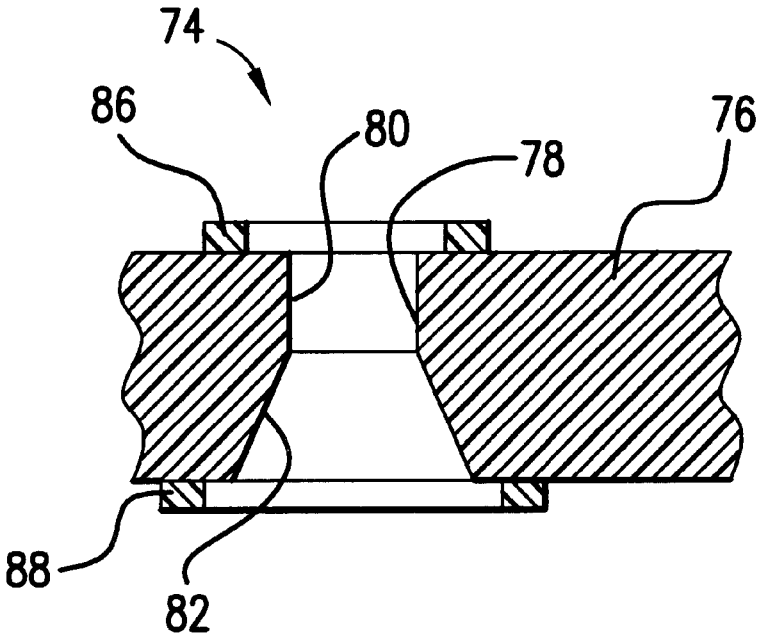
FIG. 6 is a side elevational view, partially cut away, of a second alternative embodiment of the vent of the present invention.

Referring to FIG. 6, reference numeral 74 generally indicates a vent according to a second alternative embodiment of the invention. The vent 74 is located in a lid 76 and permits air at atmospheric pressure to flow into one of the chambers 20, 21, 22, FIG. 1. The vent includes a straight bore 78 that communicates through the lid 76. The bore has a narrow upper cylindrical section 80 and an outwardly flaring section 82. The flaring section has the shape of a frustrum of a cone and opens up into the body 16, FIG. 1 of the print cartridge. The flaring section eliminates the capillary effect of drawing ink up into the bore 78 when the print cartridge is located in an upright position. Located on the top surface of the lid 76 is an annular ring 86 that prevents dust and debris from clogging the vent. Located on the chamber-side of the lid is a second annular ring 88 that additionally prevents ink from being drawn up into the vent by the capillary effect.

While the print cartridge described above contains three ink reservoirs and three vents, it is contemplated that a print cartridge with one or more reservoirs with one or more vents can also be used. In the printer that is planned for this print cartridge, one print cartridge having one reservoir containing only black ink will be installed adjacent to a second print cartridge having three reservoirs containing inks of the three primary hues.

Although specific embodiments of the invention have been described and illustrated, the invention is not to be limited to the specific forms or arrangement of parts so described and illustrated. The invention is limited only by the claims.

I claim:

1. An ink-jet print cartridge having a body and a lid attached thereto, the lid having a vent, said vent comprising: a straight bore communicating through said lid and having an opening; and a tapered annular surface surrounding said opening of said bore; further including an ink well surrounding said bore, said tapered surface connecting said opening of said bore and said ink well further including a counter bore surrounding said ink well, said ink well being located between said bore and said counter bore.

2. An ink-jet print cartridge having a body including a lid, said body having a vent comprising: said lid defining a straight bore communicating therethrough and having a pair of openings, one opening on each side of said lid; a pair of rings on said lid, each one of said pair of rings surrounding a respective one of said pair of openings of said bore; a pair of ink wells, each one of said pair of ink wells surrounding a respective one of said pair of openings of said bore, and a pair of tapering surfaces each connecting a respective one of said pair of openings of said bore and a respective one of said pair of ink wells.

3. The ink-jet print cartridge of claim 2 further including a pair of annular counter bores each defined by a respective one of said pair of rings, and each of said pair of counter bores being located on said lid and surrounding a respective one of said pair of openings of said bore.

* * * * *